US005150142A

United States Patent [19]

Masuda et al.

[11] Patent Number: 5,150,142

[45] Date of Patent: Sep. 22, 1992

[54] DEVICE FOR REPLENISHING FIXING SOLUTION EMPLOYED IN AUTOMATIC PROCESSOR

[75] Inventors: Yoshihiro Masuda; Akira Murata; Hitoshi Togawa; Nobuaki Miura, all of Kyoto, Japan

[73] Assignee: Dainippon Screen Mfg. Co., Ltd., Japan

[21] Appl. No.: 586,454

[22] Filed: Sep. 21, 1990

[30] Foreign Application Priority Data

Sep. 21, 1989 [JP] Japan ..... 1-111385[U]

[51] Int. Cl.[5] ..... G03D 3/02

[52] U.S. Cl. ..... 354/324

[58] Field of Search ..... 354/324, 323, 328, 317, 354/319, 320, 321; 430/30, 399

[56] References Cited

U.S. PATENT DOCUMENTS 4,165,186 8/1979 Tortorich et al. ..... 354/324 X

*Primary Examiner*—L. T. Hix
*Assistant Examiner*—D. Rutledge
*Attorney, Agent, or Firm*—Ostrolenk, Faber, Gerb & Soffen

[57] ABSTRACT

In a fixer replenishing device employed in an automatic processor, a hardening agent is diluted with water and then mixed with a fixing agent. Since the hardening agent is not directly mixed with the fixing agent, no crystals are deposited.

9 Claims, 7 Drawing Sheets

DEVICE FOR REPLENISHING FIXING SOLUTION EMPLOYED IN AUTOMATIC PROCESSOR

BACKGROUND OF THE INVENTION

1. Field of the Invention

The present invention relates generally to devices for replenishing fixing solutions, particularly in connection with an automatic processor for processing film, particularly high contrast film suitable for a prepress process.

2. Description of the Related Art

An apparatus for developing high contrast film, and capable of performing high-temperature high-speed processing (so-called rapid access developing) has been recently developed. This apparatus employs a developing solution and a fixing solution suitable for rapid access developing.

A replenishing solution for suitably replenishing such developing and fixing solutions is prepared by mixing different chemicals (including a diluting solution) in a predetermined ratio. This is done according to a mixed replenishment method or a separate replenishment method. In the mixed replenishment method, the chemicals are mixed together and then used for replenishment. In the separate replenishment method, the chemicals are supplied separately.

In the separate replenishment method, there is no pre-mixing of the chemicals, and hence no degradation occurs. Further, when the chemicals are diluted with water, the water can be simply supplied by a water pipe located close to the apparatus. There is no need for a water tank, and the size of tanks for replenishing the other chemicals can be reduced. The separate replenishment method has many other practical merits, e.g., a large replenisher tank which is required in the mixed replenishment method becomes unnecessary. For the foregoing reasons, the separate replenishment method has become the preferred method.

A known developer replenishing device for performing the separate replenishment method is illustrated in FIG. 1. Different chemicals A, B and water C are supplied by constant rate pumps PA, PB and PC to a fixing tank 2. Thus, a fixing solution F is replenished in a predetermined mixing ratio. The constant rate pumps PA, PB and PC suck up chemicals A, B and water C from tanks 11A, 11B and 11C.

Chemical A is a so-called fixing agent containing thiosulfate (sodium thiosulfate $Na_2S_2O_3$ and so on) as its principal component. Chemical B is a so-called hardening agent containing acid (acetic acid $CH_3COOH$ and so on), alum and so on as its components.

Referring to FIG. 2, the pipes 12A, 12B and 12C (for the chemicals A, B and water C, respectively) are arranged such that their ends extend into the solution F in the fixing tank 2, i.e., the ends are located below the surface of the solution F.

In operation, the fixing solution (mother liquor) F in the fixing tank 2 chemically reacts with the chemical B such that a crystal is deposited in the introduction pipe 12B, disadvantageously clogging the inlet of the pipe 12B and thereby varying the mixing ratio of the chemicals A and B. Actually, due to gas generated by the fixing solution F, a crystal is deposited in the pipe 12B even if the end of the introduction pipe 12B is not in contact with the surface of the fixing solution. There are two reasons for such crystal deposition, as follows:

(1) Chemical reaction between chemicals A and B:

The principal component of the chemical A, i.e., thiosulfate, is generally not stable for acid. Each of a dilute ratio of the chemical A, the chemical B, and water C to the fixing solution F is set to a concentration slightly lower than a limit (approximately pH4) at which thiosulfate is decomposed. Thus, sulfur is produced by the following reaction when the chemical A is in contact with the chemical B. $Na_2S_2O_3+2CH_3COOH \rightarrow 2CH_3COONa+H_2O+SO_2\uparrow+S\downarrow$ (2) Contact with air:

The components in the chemicals are precipitated by water evaporation in air.

SUMMARY OF THE INVENTION

One object of the present invention is therefore to prevent crystallization of chemicals in the introduction pipe and to suppress variation of the mixing ratio of the chemicals used in a separate replenishment method.

A further object of the present invention is to prevent precipitation of a crystal caused by evaporation of a mixture of chemicals in a fixer replenishing device employing a separate replenishment method.

A still further object of the present invention is to provide a chemical mixing method in which no variation of a mixing ratio of chemicals occurs upon replenishment of the chemicals in a fixer replenishing device employing a separate replenishment method.

The above-mentioned objects of the present invention are accomplished by a fixer replenishing device according to the present invention, which includes a container for holding the fixing solution, a diluting device for diluting the first liquid, supply device for supplying the diluted first liquid into the container, and a second liquid supply device for supplying the second liquid into the container.

In the present invention, the first liquid is first diluted and then mixed with the second liquid, thereby suppressing the precipitation of crystals to a minimum and consequently preventing mixing ratio variation.

According to another aspect of the present invention, the diluting device includes a first liquid holding container, a first liquid supply device for supplying the first liquid into the first liquid holding container, and a water supply device for supplying water into the first liquid holding container.

The first liquid is diluted with water in advance in the first liquid holding container. Although the first liquid makes contact with air in the first liquid holding container, the first liquid holding container is considerably larger in volume than the replenisher pipe and hence crystallization of the liquid due to evaporation hardly occurs. Therefore, crystallization in the replenisher pipe is prevented.

The present invention also relates to a method of replenishing a fixing solution employed in an automatic processor, the fixing solution being formed of first and second liquids which precipitate crystals when mixed directly. The method includes the steps of diluting the first liquid, and forming the fixing solution by mixing the diluted first liquid with the second liquid.

Since the first liquid is diluted in advance and then mixed with the second liquid, crystallization is suppressed to a minimum and no variation of mixing ratio occurs.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 3:
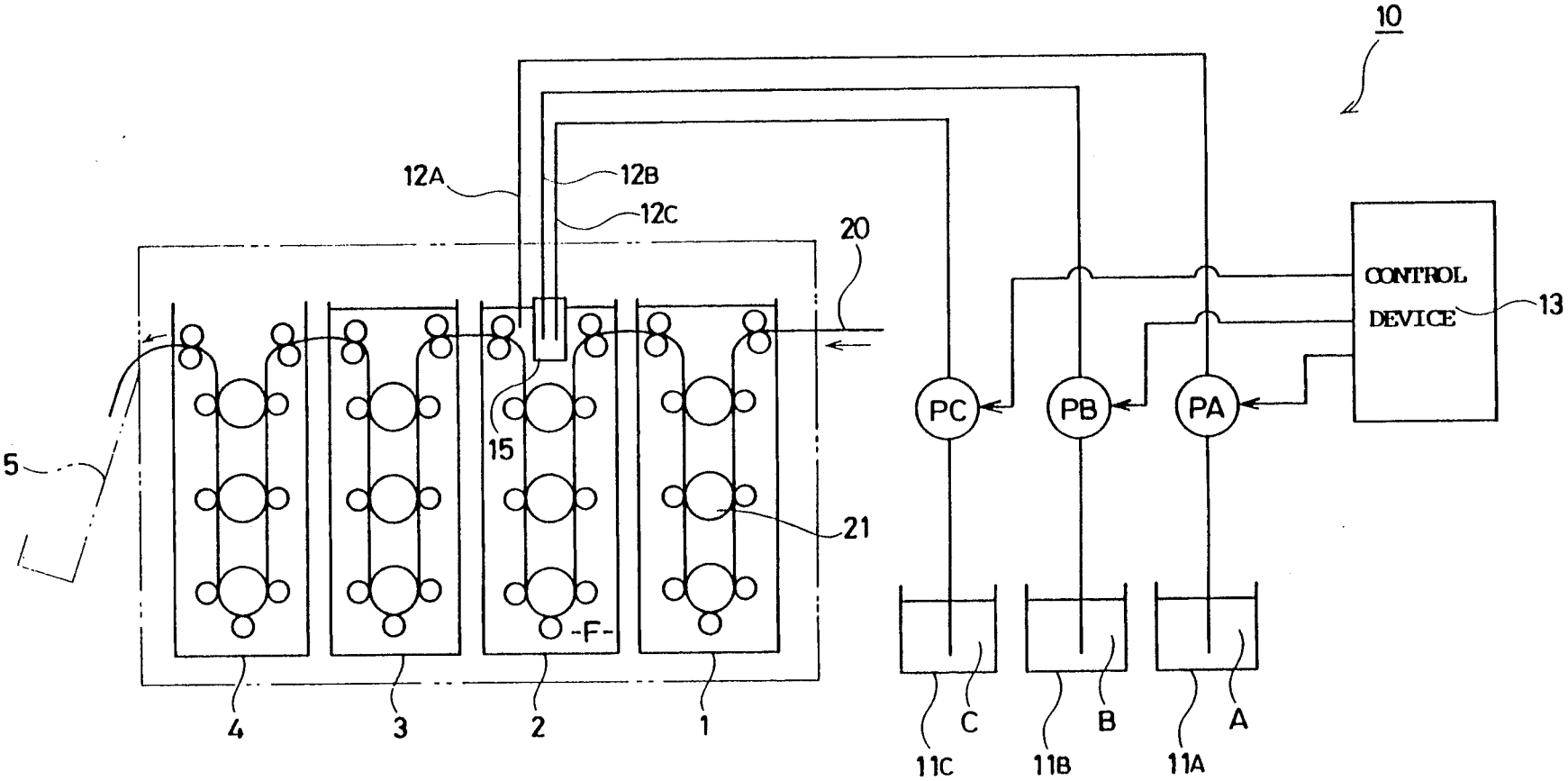
FIG. 3 is a schematic diagram of an automatic processor according to the present invention.

An automatic processor according to the present invention is illustrated in FIG. 3. The processor includes a developing tank 1, a fixing tank 2, a washing tank 3 and a drying tank 4. Exposed photosensitive material 20 is moved through the tanks 1-4 by transport rollers 21, and is discharged into a tray 5. The tank 1 is provided with a developer replenishing device (not shown). The fixing tank 2 is provided with a fixer replenishing device 10. These devices use the separate replenishment method (not the mixed replenishment method). The devices replenish each of several different chemicals based on a mixing ratio which has previously been set.

Fixer replenishing device 10 includes respective replenisher tanks 11A-11C for chemicals A, B, and water C (serving as a diluting solution), introduction pipes 12A-12C for introducing chemicals A, B and water C into fixing tank 2, constant rate pumps PA-PC connected to the introduction pipes 12A-12C, a control device 13 for driving constant rate pumps PA-PC based on the previously set mixing ratio, and an isolation box 15 (FIG. 5) for introducing chemical B into the upper portion of fixing tank 2.

Figure 4:
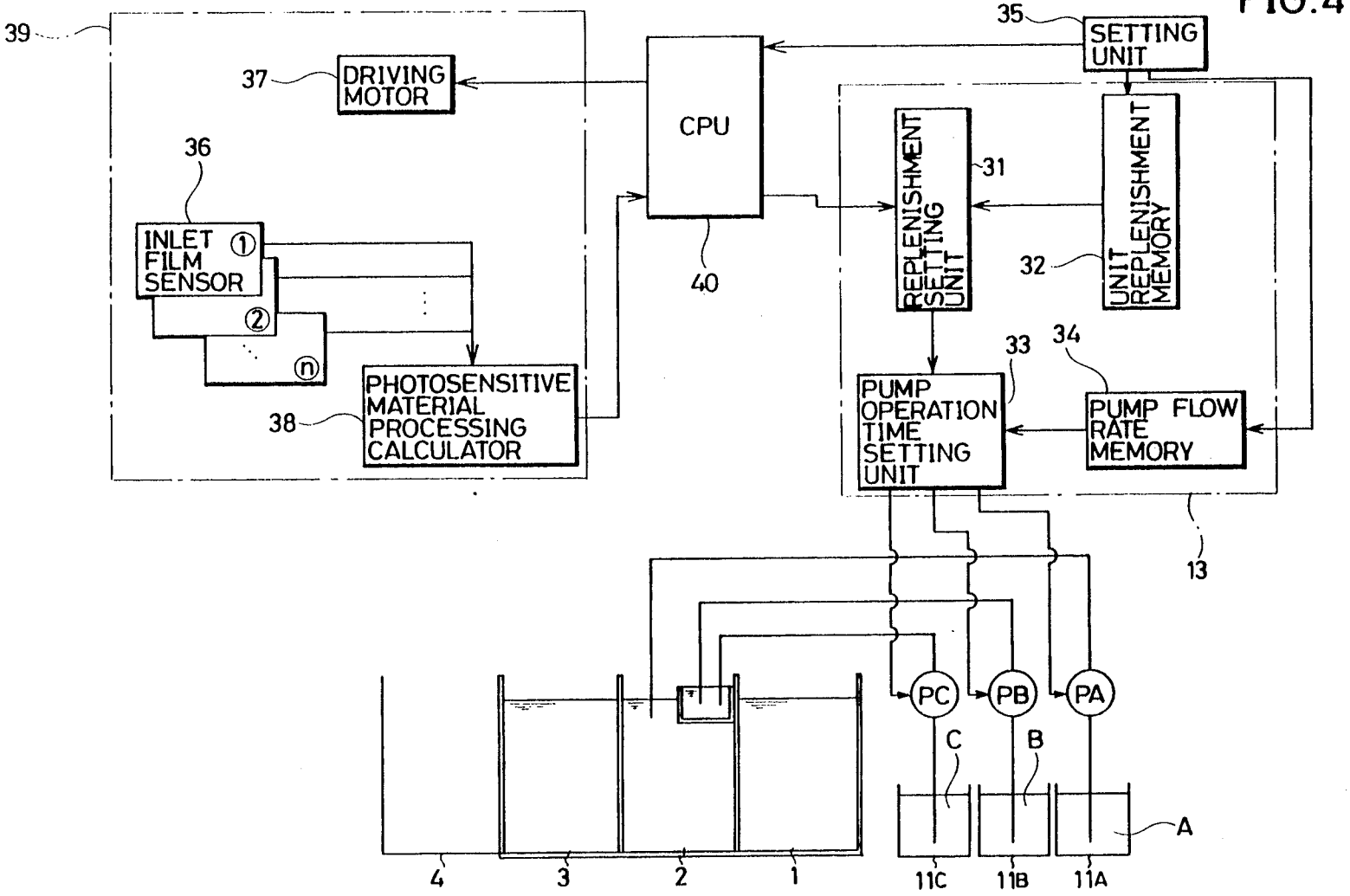
FIG. 4 is a block diagram of a controller according to the present invention.

Constant rate pumps PA-PC are, for example, bellows pumps capable of supplying a definite amount of liquid per unit time. The control device 13 includes a replenishment setting unit 31 (FIG. 4) for setting the amount of liquids to be replenished based on the amount of photosensitive material (such as film) to be processed and on the amount of liquid to be replenished per unit amount of the photosensitive material, a unit replenishment memory 32 for storing the amount to be replenished per unit amount of the photosensitive material, a pump operable time setting unit 33 for setting a time for operating the pump based on the amount to be replenished, so as to drive the pumps, and a pump flow rate memory 34 for storing the flow rate of the pump per unit time. Control device 13 is connected to a setting unit 35 (such as a keyboard) for setting a mixing ratio. Data representative of the amount of photosensitive material to be processed is transmitted from a photosensitive material processing controller 39. The controller 39 includes an inlet film sensor 36 for detecting film to be transported to the automatic processor, a driving motor 37 for driving transport rollers 21, and a photosensitive material processing calculator 38 for calculating the amount of photosensitive material to be processed based on the transport speed of the film and a signal from sensor 36. The control device 13, setting unit 35 and controller 39 are controlled by a CPU 40.

The isolation box 15 (FIG. 5) is disposed in an upper portion of the fixing tank 2. The introduction pipe 12A (for introducing the chemical A) is provided in the fixing tank 2, while the pipes 12B and 12C (for introducing the chemical B and water C) are provided in the isolation box 15. The chemical B is diluted in a dilute ratio specified by a chemical manufacturer (about several ten times) in the isolation box 15. The diluted liquid overflows from the isolation box 15 into the fixing tank 2. The isolation box 15 has already been filled with a diluting solution. Supply of the chemical B and water C to the isolation box 16 so filled causes the diluted chemical B to be sequentially supplied into the fixing solution F.

An overflow pipe 16 keeps the level of the fixing solution F lower than that of the isolation box 15. This ensures that components of the fixing solution F do not enter the pipe 12B and therefore do not clog the pipe 12B with precipitated crystals.

Figure 1:
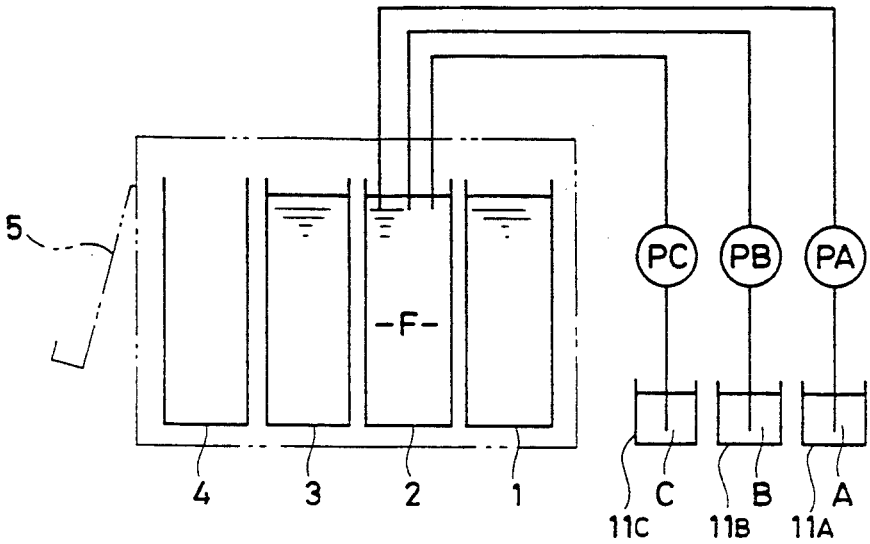
FIG.1 PRIOR ART
FIG. 1 is a schematic diagram of a conventional device for replenishing fixing solution.
Figure 2:
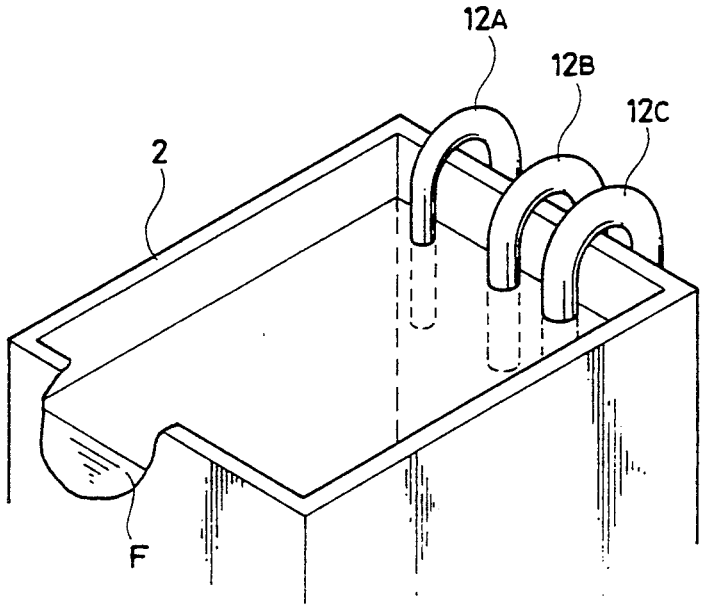
FIG.2 PRIOR ART
FIG. 2 is an enlarged perspective top view of a conventional fixing tank.

With the present invention, crystallization hardly occurs since the raw liquid chemical B does not contact the chemical A or the fixing solution F. Rather, the chemical B is first diluted several ten times with water and then contacts the mother liquor F. After replenishment of the chemicals A and B is completed, the chemical B and mother liquor F react with each other at the sidewalls of the isolation box 15; however, since only that portion of the liquids which adheres on the sidewalls of the isolation box 15 is precipitated, no problem occurs. In addition, although the sidewalls of the box 15 may possibly contact the air to form crystal precipitations, the precipitated crystals are considerably smaller than crystals formed at the outlet of the pipe 12B shown in FIG. 2 since the chemical B is diluted.

Figure 6:
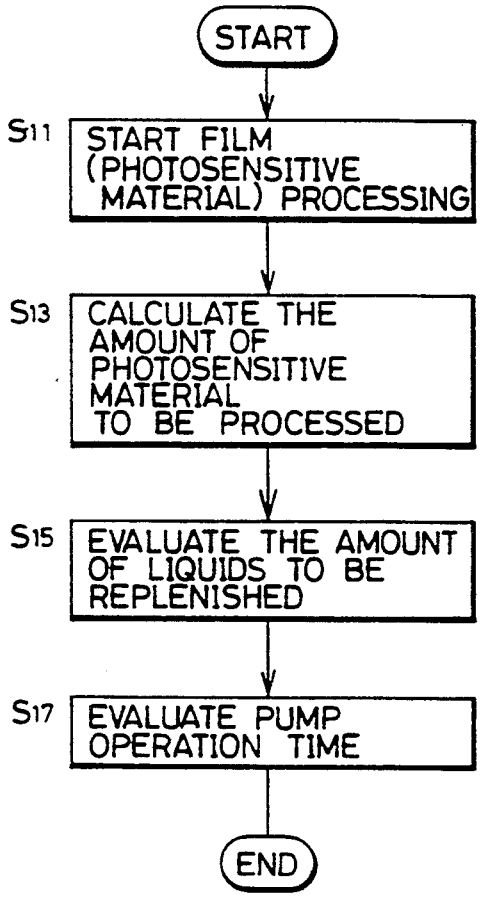
FIG. 6 is a flow chart of a method of operation according to the present invention.

In operation, film processing is started (step S11) (FIG. 6) and the amount S of the photosensitive material 20 to be processed is calculated by the calculator 38 according to the following equation:

$$S=(V\cdot t)\times(m\cdot l) \quad (1)$$

wherein V equals the speed of the motor 37, m equals the number of sensors 36, t equals the time required for the sensing, and l denotes a film width for one sensor 36 (step S13).

Then, in step S15, the amount P of the liquid to be replenished is set by the unit 31 according to the following equation:

$$P=S/Q \quad (2)$$

wherein Q denotes the amount of liquids to be replenished per unit amount of photosensitive material.

Actually, since in practice the calculation (2) is performed for each liquid, the amount P of each liquid to be replenished is evaluated according to the following equations:

$$Pa=S/Qa,\ Pb=S/Qb,\ Pc=S/Qc$$

wherein the suffixes a, b, and c denote the respective liquids.

Next, in step S17, a time T required to drive each pump is evaluated from a flow rate R of each pump per unit time in the following equations by the pump operable time setting unit 33.

$$Ta = Pa/Ra \quad (3)$$

$$Tb = Pb/Rb \quad (4)$$

$$Tc = Pc/Rc \quad (5)$$

Figure 5:
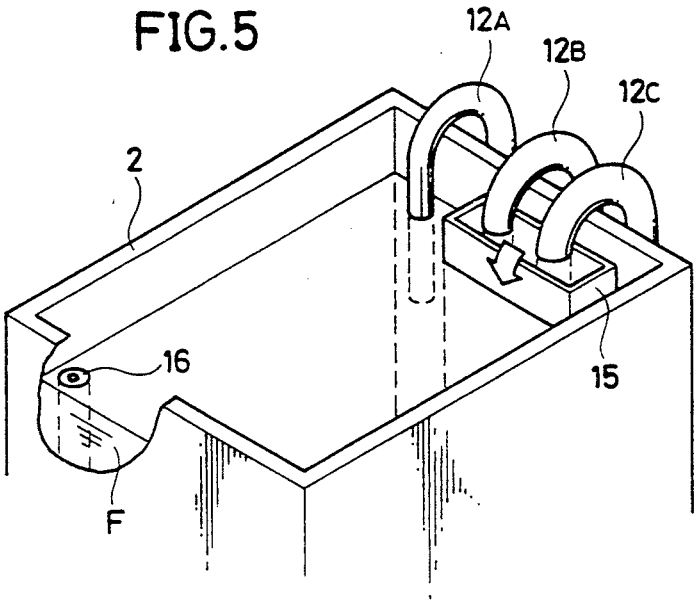
FIG. 5 is an enlarged perspective top view of a fixing tank according to the present invention.
Figure 7:
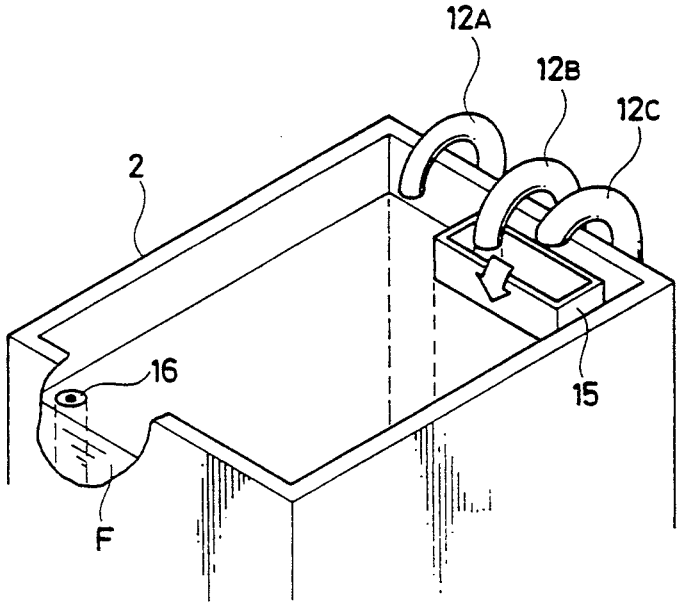
FIGS. 7-11 illustrate alternative preferred embodiments of the present invention.

In the embodiments illustrated in FIG. 5, the ends of the pipes 12A, 12B and 12C are positioned in the liquid. In an alternative embodiment illustrated in FIG. 7, the ends of the pipes 12A and 12C are positioned above the liquid surface. This is possible because the pipes 12A and 12C are not susceptible to clogging by crystallization.

Figure 8:
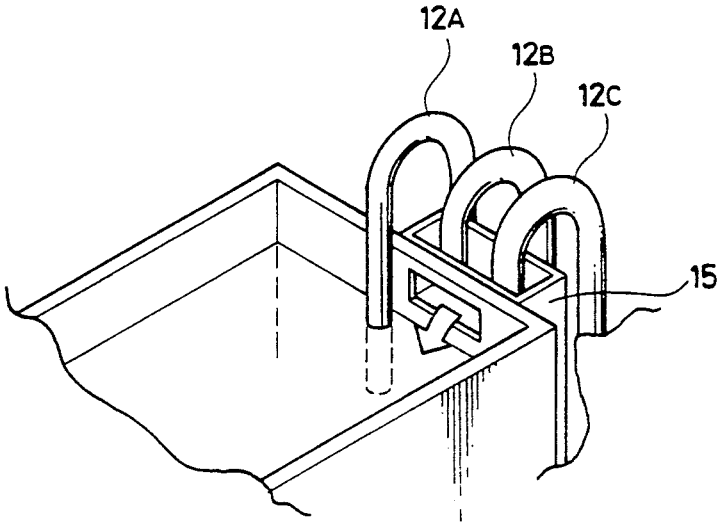
Figure 9:
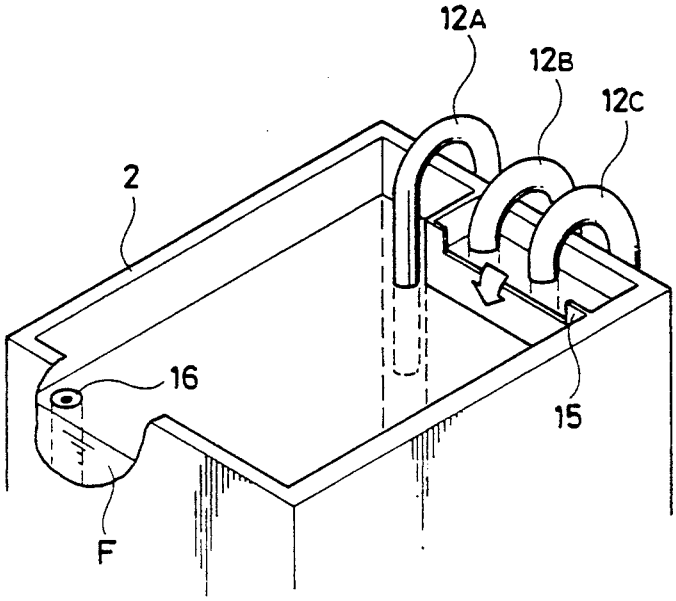

In the embodiment illustrated in FIG. 5, the isolation box 15 is provided within the fixing tank 2. In an alternative embodiment illustrated in FIG. 8, the isolation box 15 is provided outside the fixing tank 2 with dilute solution flowing into the tank 2 through an overflow opening.

The isolation box 15 may be separated from the tank 2, or the box 15 and the tank 2 may share a sidewall.

Figure 10:
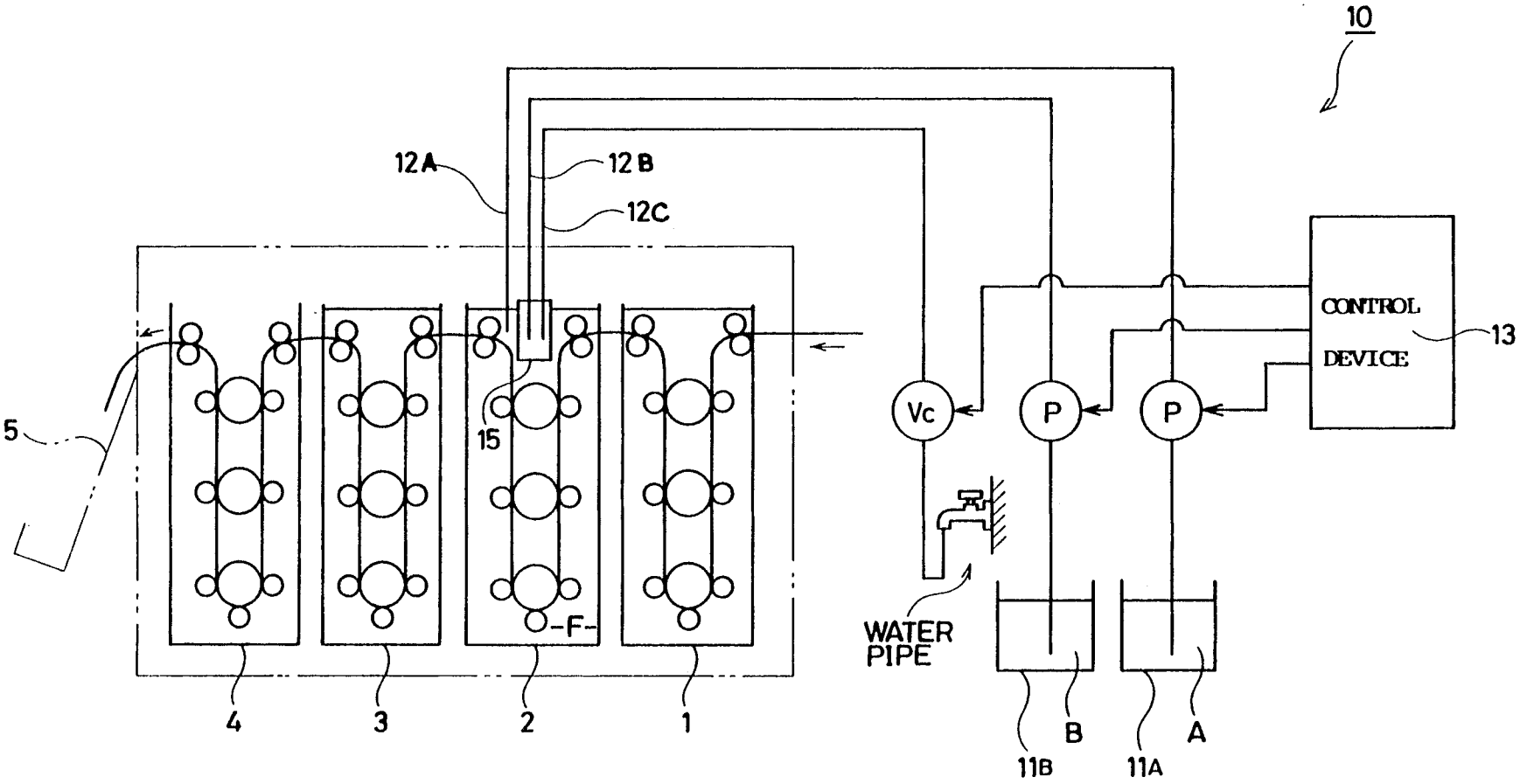

If water (serving as the diluting solution) is replenished through a water pipe, water replenishing tank 11C can be removed as shown in FIG. 10. A constant rate supply valve VC may substitute for constant rate pump PC in this case.

Figure 11:
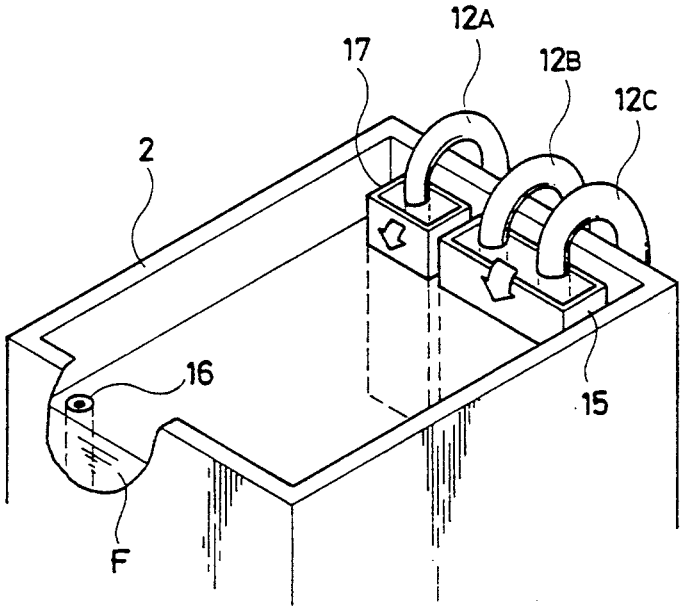

In an alternative embodiment illustrated in FIG. 11, a separate isolation box 17 is provided together with the isolation box 15, with the chemical A being supplied into the box 17 through the pipe 12A.

Although the present invention has been described and illustrated in detail, it is clearly understood that the same is by way of illustration and example only and is not to be taken by way of limitation. The spirit and scope of the present invention should be limited only by the terms of the appended claims.

What is claimed is:

1. A fixer replenishing device for mixing liquids to form a fixing solution, said device comprising:

a container for holding fixing solution, the fixing solution being a mixture of at least a first liquid and a second liquid, said first and second liquids being such that a crystal is precipitated when said first and second liquids are directly mixed together;

diluting solution supply means for diluting said first liquid to form diluted liquid, said diluting solution supply means being adjacent to said container and supplying diluted liquid to said container by overflow from said diluting solution supply means; and second liquid supply means for supplying said second liquid into said container.

2. The fixer replenishing device according to claim 1, further comprising:

first control means for controlling in advance a mixing ratio of said first liquid and diluting solution to be mixed; and second control means for controlling a mixing ratio of said diluted liquid and said second liquid to be mixed.

3. The fixer replenishing device according to claim 1, wherein said diluting solution supply means includes:

an isolation box for holding said first liquid in isolation from said fixing solution of said container means, first liquid supply means for supplying said first liquid into said isolation box, and water supply means for supplying water into said isolation box.

4. The fixer replenishing device according to claim 3, wherein said first liquid comprises a fixing agent, and said second liquid comprises a hardening agent.

5. The fixer replenishing device according to claim 4, wherein said fixing agent principally comprises thiosulfate, and said hardening agent comprises acid and alum.

6. The fixer replenishing device according to claim 3, wherein said isolation box is provided in said container for holding said fixing solution.

7. The fixer replenishing device according to claim 3, wherein said isolation box is provided outside said container for holding said fixing solution.

8. The fixer replenishing device according to claim 3, wherein said isolation box holds said diluted first liquid at a predetermined level of liquid surface higher than the surface level of said container means for allowing said diluted first liquid to overflow from said isolation box into said container means.

9. The fixer replenishing device according to claim 3, wherein said first liquid supply means has a supply nozzle for supplying said first liquid into said isolation box, said nozzle having an end held in said diluted first liquid.

* * * * *